US011575215B2

(12) United States Patent
Shor

(10) Patent No.: US 11,575,215 B2
(45) **Date of Patent: *Feb. 7, 2023**

(54) ANTENNA WITH ENHANCED AZIMUTH GAIN

(71) Applicant: ARRIS Enterprises LLC, Suwanee, GA (US)

(72) Inventor: Arie Shor, Sunnyvale, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 908 days.

This patent is subject to a terminal disclaimer.

(21) Appl. No.: 16/442,010

(22) Filed: Jun. 14, 2019

(65) Prior Publication Data

US 2019/0312344 A1 Oct. 10, 2019

Related U.S. Application Data

(63) Continuation of application No. 15/405,275, filed on Jan. 12, 2017, now Pat. No. 10,367,259.

(51) Int. Cl.

| | |
|---|---|
| ***H01Q 19/185*** | (2006.01) |
| ***H01Q 1/48*** | (2006.01) |
| ***H01Q 1/42*** | (2006.01) |
| ***H01Q 9/04*** | (2006.01) |
| ***H01Q 13/04*** | (2006.01) |

(Continued)

(52) U.S. Cl.

CPC ..... *H01Q 19/185* (2013.01); *H01Q 1/42* (2013.01); *H01Q 1/48* (2013.01); *H01Q 9/0414* (2013.01); *H01Q 13/04* (2013.01); *H01Q 13/08* (2013.01); *H01Q 1/2291* (2013.01); *H01Q 15/14* (2013.01)

(58) Field of Classification Search

CPC ..... H01Q 19/185

See application file for complete search history.

(56) References Cited

U.S. PATENT DOCUMENTS 3,774,223 A * 11/1973 Ehrenspeck ..... H01Q 19/18 343/837

3,858,221 A * 12/1974 Harrison ..... H01Q 3/26 343/846

(Continued)

FOREIGN PATENT DOCUMENTS

| | | |
|---|---|---|
| EP | 135049 B1 | 6/1988 |
| EP | 133317 B1 | 9/1988 |

*Primary Examiner* — Ab Salam Alkassim, Jr.

(74) *Attorney, Agent, or Firm* — Steven Stupp; Stewart Wiener

(57) ABSTRACT

An antenna is described. This antenna includes: a ground plane; and antenna elements that are positioned in a first horizontal plane offset along a vertical direction from the ground plane. Moreover, the antenna elements are configured to generate a beam having a horizontal polarization. Furthermore, the antenna includes a planar reflector that is positioned in a second horizontal plane offset along the vertical direction from the first ground plane, so that the antenna elements are positioned between the ground plane and the planar reflector. During operation, a first reflection from the ground plane, the beam from the antenna elements, a second reflection from the planar reflector and diffractions from edges of the ground plane and the planar reflector combine to generate an antenna radiation pattern having a main beam approximately in a horizontal direction, e.g., at 10-15° from the horizontal direction.

20 Claims, 6 Drawing Sheets

(51) Int. Cl.

| | |
|---|---|
| ***H01Q 13/08*** | (2006.01) |
| *H01Q 15/14* | (2006.01) |
| *H01Q 1/22* | (2006.01) |

(56) References Cited

U.S. PATENT DOCUMENTS

| | | | | |
|---|---|---|---|---|
| 4,291,311 | A * | 9/1981 | Kaloi | H01Q 21/065 343/700 MS |
| 4,291,312 | A | 9/1981 | Kaloi | |
| 4,347,517 | A * | 8/1982 | Kaloi | H01Q 21/067 343/840 |
| 5,614,919 | A * | 3/1997 | Pikulski | H01Q 15/02 343/897 |
| 5,936,579 | A | 8/1999 | Kapitsyn et al. | |
| 6,061,027 | A * | 5/2000 | Legay | H01Q 15/22 343/846 |
| 6,285,323 | B1 | 9/2001 | Frank | |
| 7,126,553 | B1 | 10/2006 | Fink et al. | |
| 7,138,956 | B2 | 11/2006 | Nilsson | |
| 7,893,882 | B2 | 2/2011 | Shtrom | 343/702 |
| 8,085,206 | B2 | 12/2011 | Shtrom | 343/702 |
| 8,358,248 | B2 | 1/2013 | Shtrom | |
| 8,686,905 | B2 | 4/2014 | Shtrom | 343/702 |
| 9,263,791 | B2 * | 2/2016 | Anderson | H01Q 1/246 |
| 9,270,029 | B2 | 2/2016 | Shtrom | H01Q 1/38 |
| 10,056,693 | B2 | 8/2018 | Shtrom | |
| 10,367,259 | B2 * | 7/2019 | Shor | H01Q 1/48 |
| 11,233,330 | B2 * | 1/2022 | Clauzier | H01Q 9/16 |
| 2013/0002504 | A1 * | 1/2013 | Lin | H01Q 15/006 343/834 |
| 2013/0063310 | A1 | 3/2013 | Mak et al. | |
| 2013/0178170 | A1 * | 7/2013 | Schrabler | H01Q 1/3275 343/837 |
| 2014/0022131 | A1 * | 1/2014 | Azulay | H01Q 1/007 343/727 |
| 2014/0118196 | A1 | 5/2014 | Koskiniemi | |
| 2014/0285277 | A1 | 9/2014 | Herbsommer et al. | |
| 2016/0079672 | A1 | 3/2016 | Cerreno | |
| 2017/0222318 | A1 * | 8/2017 | Li | H01Q 21/28 |
| 2017/0373401 | A1 * | 12/2017 | Visentin | H01Q 19/19 |
| 2018/0198202 | A1 * | 7/2018 | Shor | H01Q 1/48 |
| 2018/0269577 | A1 * | 9/2018 | Kosaka | H01Q 15/0013 |
| 2019/0312344 | A1 * | 10/2019 | Shor | H01Q 1/42 |
| 2020/0365994 | A1 * | 11/2020 | Clauzier | H01Q 9/0421 |
| 2022/0149514 | A1 * | 5/2022 | Tsuchiya | H01Q 9/0414 |

* cited by examiner

ANTENNA WITH ENHANCED AZIMUTH GAIN

CROSS-REFERENCE TO RELATED APPLICATION

This application is a continuation of U.S. application Ser. No. 15/405,275 (now U.S. Pat. No. 10,367,259), filed Dec. 31, 2015.

BACKGROUND

Field

The described embodiments relate to techniques for communicating information among electronic devices. In particular, the described embodiments relate to techniques for enhancing the azimuth gain of an antenna in an electronic device.

Related Art

Many electronic devices are capable of wirelessly communicating with other electronic devices. In particular, these electronic devices can include a networking subsystem that implements a network interface for: a cellular network (WITS, LTE, etc.), a wireless local area network (e.g., a wireless network such as described in the Institute of Electrical and Electronics Engineers (IEEE) 802.11 standard or Bluetooth from the Bluetooth Special Interest Group of Kirkland, Wash.), and/or another type of wireless network.

For example, many electronic devices communicate with each other via wireless local area networks (WLANs) using an IEEE 802.11-compatible communication protocol (which are sometimes collectively referred to as Wi-Fi'). In a typical deployment, a Wi-Fi-based WLAN includes one or more access points (or basic service sets or BSSs) that communicate wirelessly with each other and with other electronic devices using Wi-Fi, and that provide access to another network (such as the Internet) via IEEE 802.3 (which is sometimes referred to as 'Ethernet').

An access point includes one or more antennas having associated ranges that facilitate the wireless communication. Moreover, the range of an antenna is usually determined by the antenna gain, polarization and the type of antenna (i.e., the antenna size and configuration), as well as the frequency band, the modulation technique and the radio output power. An antenna with a higher gain rating typically deviates (in genera toward the horizontal direction) from the antenna radiation pattern of a theoretical or ideal isotropic radiator. Thus, for the same radio output power, an antenna with a higher gain rating can project a usable signal further than a more isotropic antenna.

However, the antenna gain of many antennas in access points are often limited by the antenna configuration. In particular, many antennas have an asymmetric configuration in which one or more antenna elements is positioned above a ground plane. Reflections and diffractions off of the ground plane and its edges can cause the direction of the main beam (which is sometimes referred to as the 'elevation') in the antenna radiation pattern to tilt away from the horizontal direction, which may degrade the antenna gain and, thus, the range of the access point. Therefore, the limitations of existing antennas can degrade the user experience when attempting to communicate using a WLAN.

SUMMARY

The described embodiments relate to a wireless communication device. This wireless communication device includes an interface circuit and an antenna. The antenna includes: a ground plane; and antenna elements, coupled to the interface circuit, which are positioned in a first horizontal plane offset along a vertical direction from the ground plane. Moreover, the antenna elements are configured to generate a beam having a horizontal polarization. Furthermore, the antenna includes a planar reflector that is positioned in a second horizontal plane offset along the vertical direction from the first ground plane, so that the antenna elements are positioned between the ground plane and the planar reflector.

Note that the ground plane may include a first printed circuit board and the planar reflector may include a second printed circuit board or additional antenna elements.

Moreover, the planar reflector may float with respect to the ground plane.

Furthermore, a first distance between the first horizontal plane and the ground plane may be different from a second distance between the second horizontal plane and the first horizontal plane.

Additionally, the antenna may include a dielectric post between the antenna elements and the planar reflector.

In some embodiments, the antenna includes a switch or a phase-shifter that selectively electrically couples the planar reflector to the ground plane.

Moreover, the planar reflector may include metal. More generally, the planar conductor may have a resistivity less than $10^{-6}$ Ω·m at 20 C.

Furthermore, a direction of a main beam in an antenna radiation pattern of the antenna may be at 10-15° from a horizontal direction.

Additionally, the antenna may include a radome, and the planar reflector may be included in or coupled to the radome.

Note that the wireless communication device may be configured to mount on a ceiling.

Another embodiment provides the antenna.

Another embodiment provides a method for generating an antenna radiation pattern using an antenna. During the method, antenna elements may be driven by an interface circuit to generate a beam having a horizontal polarization. Then, a first reflection from a ground plane in the antenna, the beam from the antenna elements, a second reflection from a planar reflector in the antenna and diffractions from edges of the ground plane and the planar reflector combine to generate the antenna radiation pattern having a main beam approximately in a horizontal direction (e.g., at 10-15° from a horizontal direction).

This Summary is provided for purposes of illustrating some exemplary embodiments, so as to provide a basic understanding of some aspects of the subject matter described herein. Accordingly, it will be appreciated that the above-described features are examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

An antenna is described. This antenna includes: a ground plane; and antenna elements that are positioned in a first horizontal plane offset along a vertical direction from the ground plane. Moreover, the antenna elements are configured to generate a beam having a horizontal polarization. Furthermore, the antenna includes a planar reflector that is positioned in a second horizontal plane offset along the vertical direction from the first ground plane, so that the antenna elements are positioned between the ground plane and the planar reflector. During operation, a first reflection from the ground plane, the beam from the antenna elements, a second reflection from the planar reflector and diffractions from edges of the ground plane and the planar reflector combine to generate an antenna radiation pattern having a main beam approximately in a horizontal direction, e.g., at 10-15° from the horizontal direction (which is a nonlimiting example).

By generating an antenna radiation pattern having a main beam that is approximately in the horizontal direction, this communication technique may increase the antenna gain of the antenna along the horizontal direction (which is sometimes referred to as the 'azimuth gain'). Therefore, the communication technique may increase the range of a wireless communication device that includes the antenna and/or may allow the use of reduced radio transmit power. For example, the antenna may increase the range and/or decrease the power consumption of the wireless communication device, such as an access point. Consequently, the communication technique may increase the performance during wireless communication, and thus may enhance the user experience when using the access point (and, more generally, the wireless communication device).

In the discussion that follows, an access point is used as an illustrative example of the wireless communication device.

Moreover, an electronic device and the access point communicate packets in accordance with a communication protocol, such as an Institute of Electrical and Electronics Engineers (IEEE) 802.11 standard (which is sometimes referred to as 'Wi Fi,' from the Wi-Fi Alliance of Austin, Tex.), Bluetooth (from the Bluetooth Special Interest Group of Kirkland, Wash.), and/or another type of wireless interface. In the discussion that follows, Wi-Fi is used as an illustrative example. However, a wide variety of communication protocols (such as Long Term Evolution or LTE, another cellular-telephone communication protocol, etc.) may be used.

Figure 1:
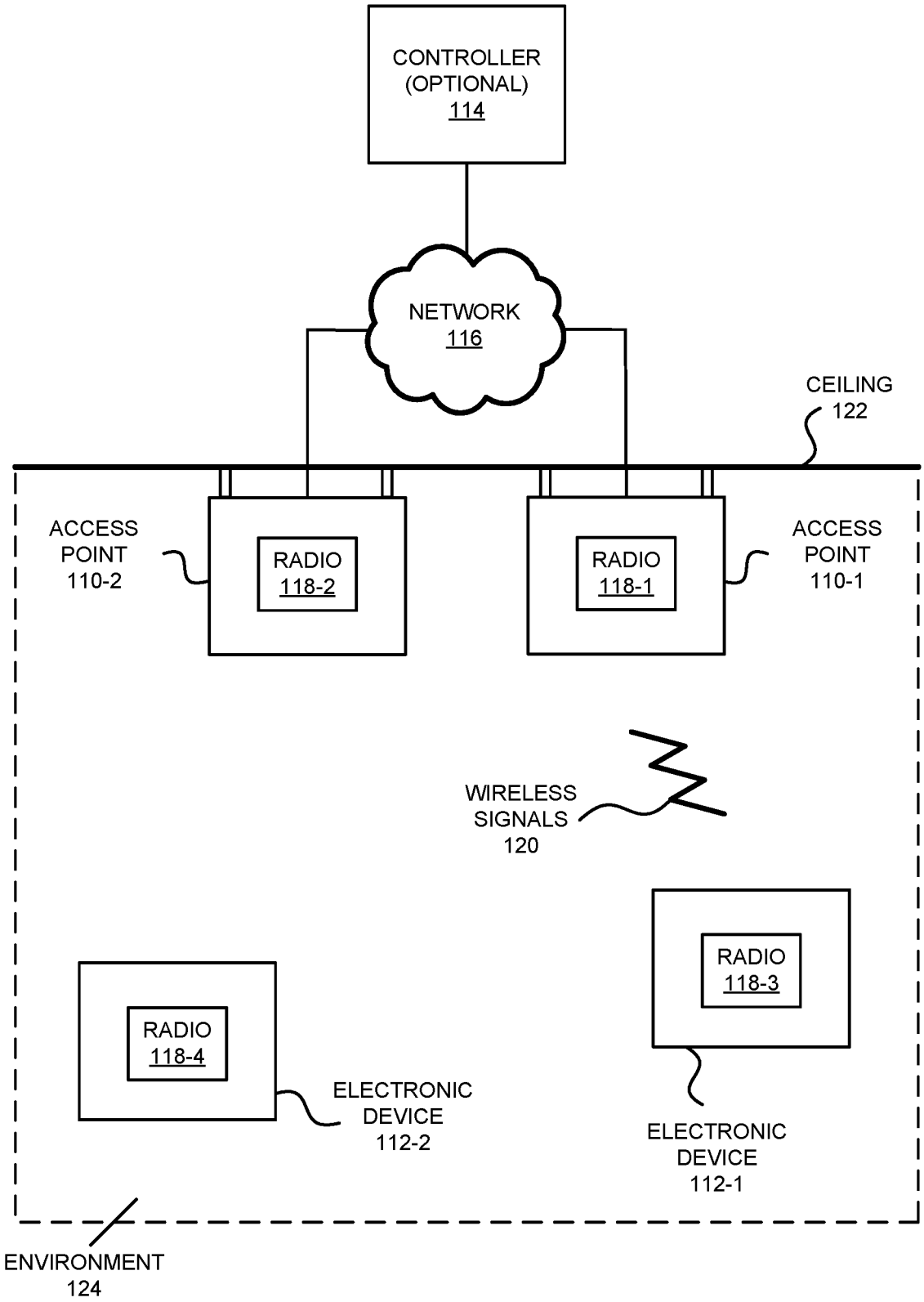
FIG. 1 is a block diagram illustrating communication among access points and electronic devices in a wireless local area (WLAN) in accordance with an embodiment of the present disclosure.

FIG. 1 presents a block diagram illustrating an example of communication among one or more access points (APs) 110 and electronic devices 112 (such as a cellular telephone) in a WLAN in accordance with some embodiments. In particular, access points 110 may communicate with each other using wireless and/or wired communication, and access points 110 may communicate with optional controller 114. (However, in some embodiments, optional controller 114 is a virtual controller, such as a controller than is implemented in software in an environment on a server.) In addition, at least some of access points 110 may communicate with electronic devices 112 using wireless communication.

The wired communication may occur via network 116 (such as an intra-net, a mesh network, point-to-point connections and/or the Internet) and may use a network communication protocol, such as Ethernet. Moreover, the wireless communication using Wi-Fi may involve: transmitting advertising frames on wireless channels, detecting one another by scanning wireless channels, establishing connections (for example, by transmitting association or attach requests), and/or transmitting and receiving packets (which may include the association requests and/or additional information as payloads). In some embodiments, the wireless communication among access points 110 also involves the use of dedicated connections.

Figure 6:
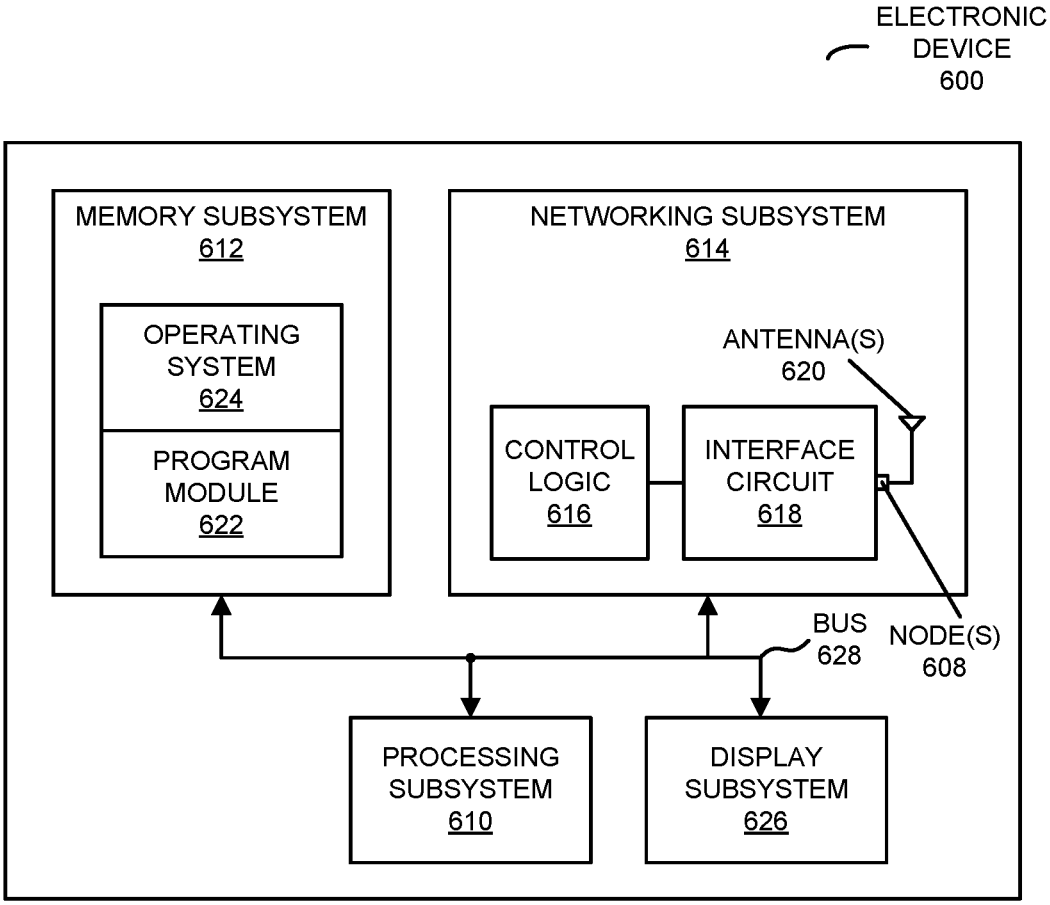
FIG. 6 is a block diagram illustrating an electronic device in accordance with an embodiment of the present disclosure.

As described further below with reference to FIG. 6, access points 110, electronic devices 112, and/or optional controller 114 may include subsystems, such as a networking subsystem, a memory subsystem and a processor subsystem. In addition, access points 110 and electronic devices 112 may include radios 118 in the networking subsystems. More generally, access points 110 and electronic devices 112 can include (or can be included within) any electronic devices with the networking subsystems that enable access points 110 and electronic devices 112 to wirelessly communicate with each other. This wireless communication can comprise transmitting advertisements on wireless channels to enable access points 110 and/or electronic devices 112 to make initial contact or detect each other, followed by exchanging subsequent data/management frames (such as association requests and responses) to establish a connection, configure security options (e.g., Internet Protocol Security), transmit and receive packets or frames via the connection, etc. Note that while instances of radios 118 are shown in access points 110 and electronic devices 112, one or more of these instances may be different from the other instances of radios 118.

As can be seen in FIG. 1, wireless signals 120 (represented by a jagged line) are transmitted from radio 118-1 in access point 110-1. These wireless signals tray be received by radio 118-3 in electronic device 112-1. In particular, access point 110-1 may transmit packets. In turn, these packets may be received by electronic device 112-1. Moreover, access point 110-1 may allow electronic device 112-1 to communicate with other electronic devices, computers and/or servers via network 116.

Note that the communication among access points 110 and/or with electronic devices 112 may be characterized by a variety of performance metrics, such as: a received signal strength (RSSI) a data rate, a data rate for successful communication (which is sometimes referred to as a 'throughput'), an error rate (such as a retry or resend rate), a mean-square error of equalized signals relative to an equalization target, intersymbol interference, multipath interference, a signal-to-noise ratio, a width of an eye pattern, a ratio of number of bytes successfully communicated during a time interval (such as 1-10 s) to an estimated maximum number of bytes that can be communicated in the time interval (the latter of which is sometimes referred to as the 'capacity' of a communication channel or link), and/or a ratio of an actual data rate to an estimated data rate (which is sometimes referred to as 'utilization').

In the described embodiments processing a packet or frame in access points 110 and electronic devices 112 includes: receiving wireless signals 120 with the packet or frame; decoding/extracting the packet or frame from received wireless signals 120 to acquire the packet or frame; and processing the packet or frame to determine information contained in the packet or frame.

Although we describe the network environment shown in FIG. 1 as an example, in alternative embodiments, different numbers or types of electronic devices may be present. For example, some embodiments comprise more or fewer electronic devices. As another example, in another embodiment, different electronic devices are transmitting and/or receiving packets or frames.

As noted previously, the elevation of the main or peak beam in an antenna radiation pattern of antenna elements mounted or positioned above a horizontal ground plane is often offset from a horizontal direction. For example, the elevation can be as much as 40°, which limits the antenna gain along the horizontal direction because wireless energy is misdirected. In an attempt to increase the antenna range (i.e., to reach long distances close to the horizon), the radio transmit power can be increased. However, this increases the power consumption.

As described further below with reference to FIGS. 2-5, in order to address this challenge one or more of access points 110 may include radios 118 with one or more modified antennas that have an antenna radiation pattern with a main or peak beam that is approximately in a horizontal direction. The modified antenna may include a planar reflector that tilts or redirects the main beam towards the horizontal direction.

Figure 2:
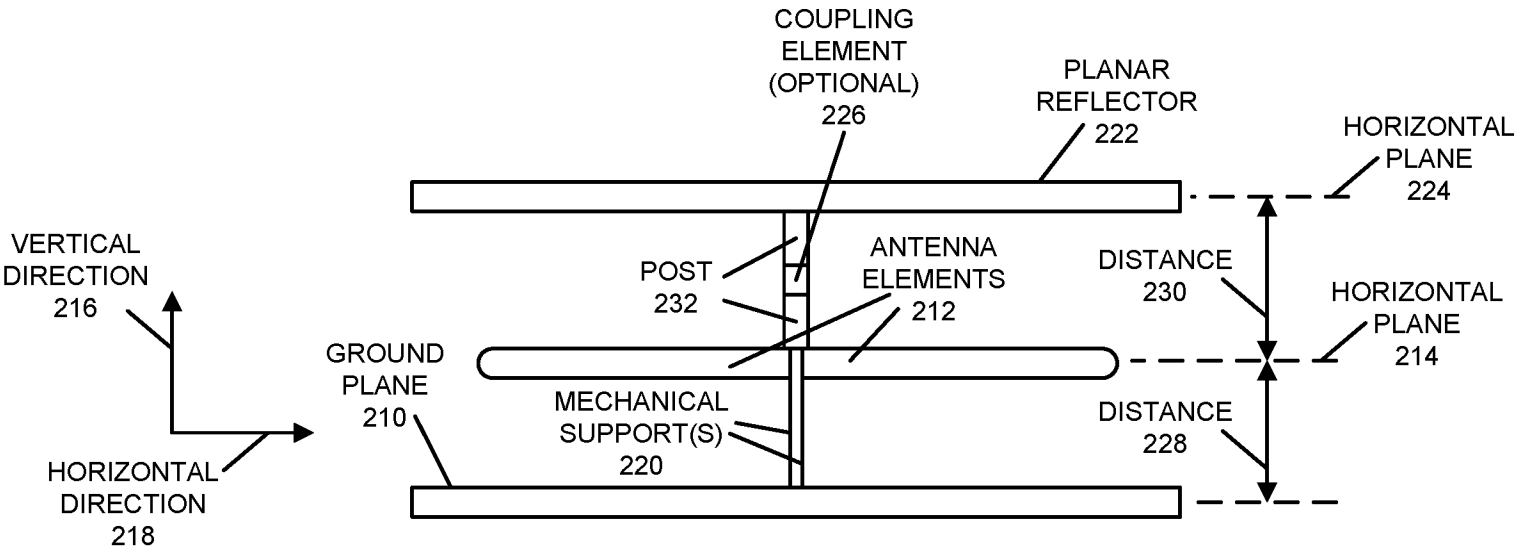
FIG. 2 is a drawing illustrating a side view of an antenna for use in one of the access points of FIG. 1 in accordance with an embodiment of the present disclosure.

This is shown in FIG. 2, which presents a drawing illustrating an example of a side view of an antenna 200 for use in one of access points 110 (FIG. 1). In particular, antenna 200 may include: a horizontal ground plane 210; and one or more antenna elements 212 that are positioned in a horizontal plane 214 offset along a vertical direction 216 from ground plane 210. These antenna elements may be driven by an interface circuit in a radio (such as radio 118-1 in FIG. 1), and may generate a beam or electromagnetic radiation having a horizontal polarization (i.e., a polarization parallel to horizontal direction 218). Thus, antenna elements 212 may be held up or positioned by one or more dielectric mechanical supports 220 that electrically couple to the interface circuit. Furthermore, antenna 200 may include a plate or planar reflector 222 that is positioned in a horizontal plane 224 offset along vertical direction 216 from ground plane 210, so that antenna elements 212 are positioned between ground plane 210 and planar reflector 222.

Note that ground plane 210 may include a first printed circuit board and/or planar reflector 222 may include a second printed circuit board. However, in some embodiments, planar reflector 222 includes additional passive antenna elements, such as another instance of antenna elements 212.

More generally, planar reflector 222 may be a passive reflector. In particular, planar reflector 222 may include a metal or a conductor, such as a material that has a resistivity less than $10^{-6}$ Ω·m at 20 C. For example, planar reflector 222 may include gold or aluminum foil, with a thickness of at least the minimum skin depth at the frequency band(s) of operation of antenna 200.

In some embodiments, planar reflector 222 floats with respect to ground plane 210, i.e., planar reflector 222 is not electrically coupled to ground plane 210. However, in some embodiments, planar reflector 222 is at least selectively electrically coupled to ground plane 210 or the interface circuit. For example, antenna 200 may include optional coupling element 226, such as a switch or a phase-shifter.

In antenna 200, ground plane 210 may be a distance 228 from horizontal plane 214 (and, thus, from antenna elements 212). Moreover, planar reflector 222 may be a distance 230 from horizontal plane 224 (and, thus, from antenna elements 212). In general, distances 228 and 230 depend on the frequency band(s) of operation of antenna 200. Therefore, distances 228 and 230 may be the same or may be different from each other. In a nonlimiting example, distance 228 may be 30-60 mm and distance 230 may be 30-40 mm.

Figure 3:
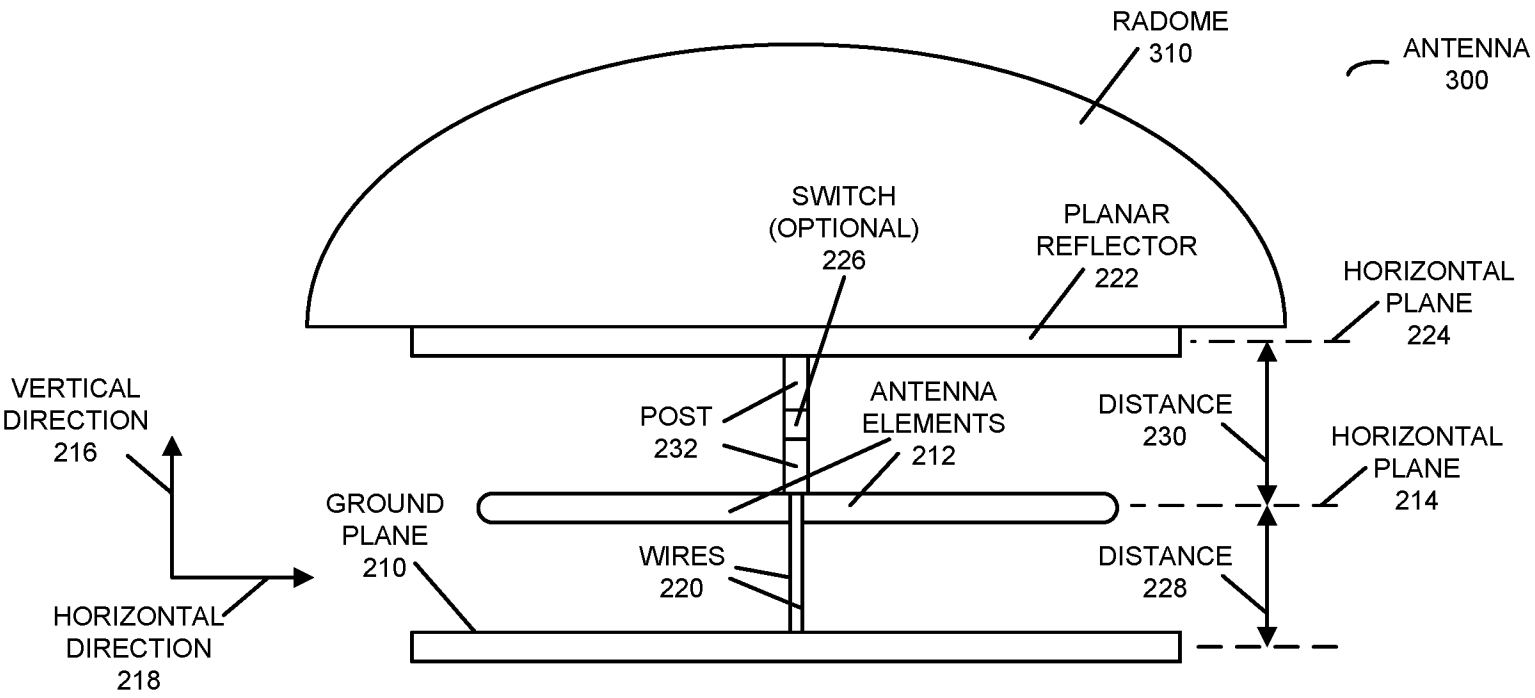
FIG. 3 is a drawing illustrating a side view of an antenna for use in one of the access points of FIG. 1 in accordance with an embodiment of the present disclosure.

Note that planar reflector 222 may be held or positioned in antenna 200 using one or more dielectric posts, such as post 232. Alternatively or additionally, planar reflector 222 may be included in or mechanically coupled to a radome or housing in the antenna. This is shown in FIG. 3, which presents a drawing illustrating an example of a side view of an antenna 300 for use in one of access points 110 (FIG. 1) and that includes radome 310.

Figure 4:
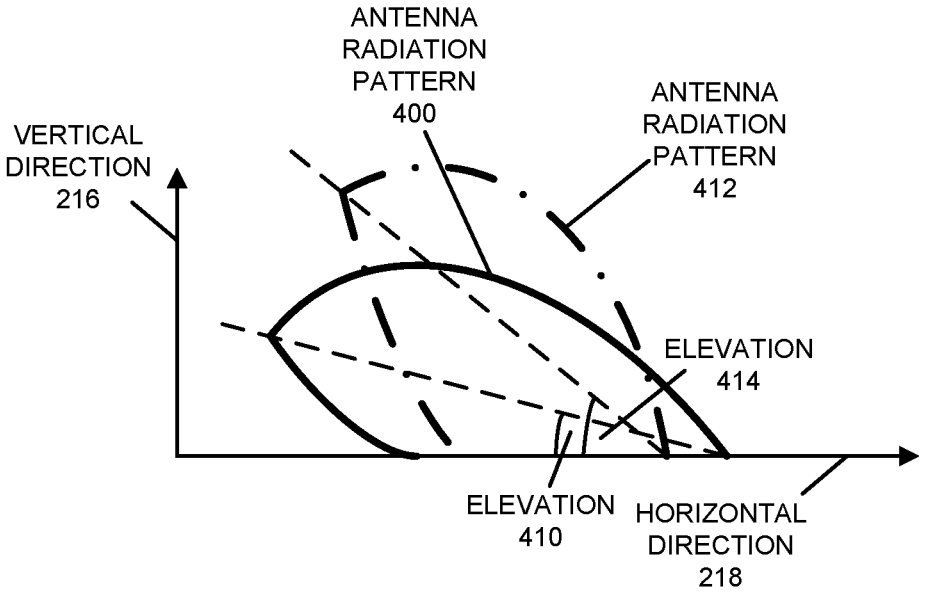
FIG. 4 is a drawing illustrating an antenna radiation pattern of the antenna in FIG. 2 or 3 in accordance with an embodiment of the present disclosure.

During operation of antenna 200 (FIG. 2) or 300, the beam produced by antenna elements 212 reflects off of ground plane 210 and planar reflector 222. Moreover, diffractions may occur due to the electric field hitting the ground edges. The resulting superposition of the beam and the reflections/diffractions generates an antenna radiation pattern that is approximately in a horizontal direction. This is illustrated in FIG. 4, which presents a drawing illustrating an antenna radiation pattern 400 of antennas 200 (FIG. 2) or 300 (FIG. 3). In particular, antenna radiation pattern 400 may have an elevation 410 of the main beam that is approximately in or is closer to a horizontal direction 218. For example, in a nonlimiting example, elevation 410 may be 10-15°.

In contrast, if planar reflector 222 (Ms. 2 and 3) is removed, the resulting antenna radiation pattern 412 may have an elevation 414 that is further away from horizontal direction 218 (i.e., that is more along vertical direction 216). In particular, elevation 414 may be approximately 40°.

Referring back to FIG. 1, this configuration of the modified antenna (such as antenna 200 in FIG. 2 or antenna 300 in FIG. 3) may extend the range of and/or may reduce the power consumption of one or more of access points 110 (such as by allowing a smaller radio transmit power to be used). For example, if one or more of access points 110 (such as access point 110-1) is mounted on a ceiling 122 of an environment 124 (such as a room) approximately 10 ft above the floor, an elevation of 10-15° may extend the range to the horizon of access point 110-1 for a given radio transmit power. In some embodiments, the range is at least 50 ft and the antenna gain at the horizon of the modified antenna may be increased by a few dB.

Note that the modified antenna may be an omnidirectional antenna or a directional antenna. In some embodiments, the directionality of the modified antenna is dynamically configured or adjusted. Moreover, the modified antenna configured to operate in one or more frequency bands. For example, the one or more frequency bands may include: a 900 MHz frequency band, a 2.4 GHz frequency band, a 3.65 GHz frequency band, a 4.9 GHz frequency band, a 5 GHz frequency band, a 5.9 GHz frequency band, a 60 GHz frequency band and/or another frequency band.

Figure 5:
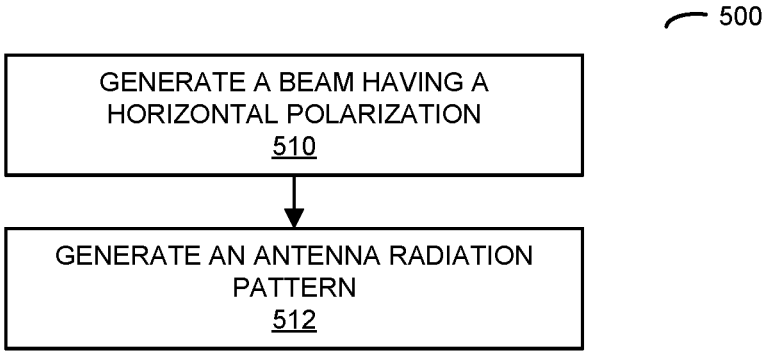
FIG. 5 is a flow diagram illustrating a method for generating an antenna radiation pattern using an antenna in accordance with an embodiment of the present disclosure.

We now describe embodiments of the method. FIG. 5 presents a flow diagram illustrating a method 500 for generating an antenna radiation pattern using an antenna, such as antenna 200 (FIG. 2) or 300 (FIG. 3). During operation, an interface circuit drives the antenna to generate a beam (operation 510) having a horizontal polarization. Then, a first reflection from a ground plane in the antenna, the beam from the antenna elements, a second reflection from a planar reflector in the antenna and diffractions from edges of the ground plane and the planar reflector combine to generate the antenna radiation pattern (operation 512) having a main beam approximately in a horizontal direction.

In some embodiments of method 500, there may be additional or fewer operations. Furthermore, the order of the operations may be changed, and/or two or more operations may be combined into a single operation.

We now describe embodiments of an electronic device, which may perform at least some of the operations in the communication technique. FIG. 6 presents a block diagram illustrating an electronic device 600 in accordance with some embodiments, such as one of access points 110, electronic devices 112, or optional controller 114. This electronic device includes processing subsystem 610, memory subsystem 612, and networking subsystem 614. Processing subsystem 610 includes one or more devices configured to perform computational operations. For example, processing subsystem 610 can include one or more microprocessors, ASICs, microcontrollers, programmable-logic devices, and/or one or more digital signal processors (DSPs).

Memory subsystem 612 includes one or more devices for storing data and/or instructions for processing subsystem 610 and networking subsystem 614. For example, memory subsystem 612 can include dynamic random access memory (DRAM), static random access memory (SRAM), and/or other types of memory. In some embodiments, instructions for processing subsystem 610 in memory subsystem 612 include: one or more program modules or sets of instructions (such as program module 622 or operating system 624), which may be executed by processing subsystem 610. Note that the one or more computer programs may constitute a computer-program mechanism. Moreover, instructions in the various modules in memory subsystem 612 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 610.

In addition, memory subsystem 612 can include mechanisms for controlling access to the memory. In some embodiments, memory subsystem 612 includes a memory hierarchy that comprises one or more caches coupled to a memory in electronic device 600. In some of these embodiments, one or more of the caches is located in processing subsystem 610.

In some embodiments, memory subsystem 612 is coupled to one or more high-capacity mass-storage devices (not shown). For example, memory subsystem 612 can be coupled to a magnetic or optical drive, a solid-state drive, or another type of mass-storage device. In these embodiments, memory subsystem 612 can be used by electronic device 600 as fast-access storage for often-used data, while the mass-storage device is used to store less frequently used data.

Networking subsystem 614 includes one or more devices configured to couple to and communicate on a wired and/or wireless network (i.e., to perform network operations), including: control logic 616, an interface circuit 618 and one or more antennas 620 (or antenna elements). (While FIG. 6 includes one or more antennas 620, in some embodiments electronic device 600 includes one or more nodes, such as nodes 608, e.g., a pad, which can be coupled to the one or more antennas 620. Thus, electronic device 600 may or may not include the one or more antennas 620.) For example, networking subsystem 614 can include a Bluetooth™ networking system, a cellular networking system (e.g., a 3G/4G network such as UMTS, LTE, etc.), a universal serial bus (USB) networking system, a networking system based on the standards described in IEEE 802.11 (e.g., a Wi-Fi® networking system), an Ethernet networking system, and/or another networking system.

Note that a transmit or receive antenna pattern (or antenna radiation pattern) of electronic device 600 may be adapted or changed using pattern shapers (such as reflectors) in one or more antennas 620 (or antenna elements), which can be independently and selectively electrically coupled to ground to steer the transmit antenna pattern in different directions. Thus, if one or more antennas 620 include N antenna pattern shapers, the one or more antennas may have $2^N$ different antenna pattern configurations. More generally, a given antenna pattern may include amplitudes and/or phases of signals that specify a direction of the main or primary lobe of the given antenna pattern, as well as so-called 'exclusion regions' or 'exclusion zones' (which are sometimes referred to as 'notches' or 'nulls'). Note that an exclusion zone of the given antenna pattern includes a low-intensity region of the given antenna pattern. While the intensity is not necessarily zero in the exclusion zone, it may be below a threshold, such as 3 dB or lower than the peak gain of the given antenna pattern. Thus, the given antenna pattern may include a local maximum (e.g., a primary beam) that directs gain in the direction of electronic device 600 that is of interest, and one or more local minima that reduce gain in the direction of other electronic devices that are not of interest. In this way, the given antenna pattern may be selected so that communication that is undesirable (such as with the other electronic devices) is avoided to reduce or eliminate adverse effects, such as interference or crosstalk.

Networking subsystem 614 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. Moreover, in some embodiments a 'network' or a 'connection' between the electronic devices does not yet exist. Therefore, electronic device 600 may use the mechanisms in networking subsystem 614 for performing simple wireless communication between the electronic devices, e.g., transmitting advertising or beacon frames and/or scanning for advertising frames transmitted by other electronic devices as described previously.

Within electronic device 600, processing subsystem 610, memory subsystem 612, and networking subsystem 614 are coupled together using bus 628. Bus 628 may include an electrical, optical, and/or electro-optical connection that the subsystems can use to communicate commands and data among one another. Although only one bus 628 is shown for clarity, different embodiments can include a different number or configuration of electrical, optical, and/or electro-optical connections among the subsystems.

In some embodiments, electronic device 600 includes a display subsystem 626 for displaying information on a display, which may include a display driver and the display, such as a liquid-crystal display, a multi-touch touchscreen, etc.

Electronic device 600 can be (or can be included in) any electronic device with at least one network interface. For example, electronic device 600 can be (or can be included in): a desktop computer, a laptop computer, a subnotebook/netbook, a server, a tablet computer, a smartphone, a cellular telephone, a smartwatch, consumer-electronic device, a portable computing device, an access point, a transceiver, a router, a switch, communication equipment, an access point, a controller, test equipment, and/or another electronic device.

Although specific components are used to describe electronic device 600, in alternative embodiments, different components and/or subsystems may be present in electronic device 600. For example, electronic device 600 may include one or more additional processing subsystems, memory subsystems, networking subsystems, and/or display subsystems. Additionally, one or more of the subsystems may not be present in electronic device 600. Moreover, in some embodiments, electronic device 600 may include one or more additional subsystems that are not shown in FIG. 6. Also, although separate subsystems are shown in FIG. 6, in some embodiments some or all of a given subsystem or component can be integrated into one or more of the other subsystems or component(s) in electronic device 600. For example, in some embodiments program module 622 is included in operating system 624 and/or control logic 616 is included in interface circuit 618.

Moreover, the circuits and components in electronic device 600 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit (which is sometimes referred to as a 'communication circuit') may implement some or all of the functionality of networking subsystem 614. The integrated circuit may include hardware and/or software mechanisms that are used for transmitting wireless signals from electronic device 600 and receiving signals at electronic device 600 from other electronic devices. Aside from the mechanisms herein described, radios are generally known in the art and hence are not described in detail. In general, networking subsystem 614 and/or the integrated circuit can include any number of radios. Note that the radios in multiple-radio embodiments function in a similar way to the described single-radio embodiments.

In some embodiments, networking subsystem 614 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals)

In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII) or Electronic Design Interchange Format (EDIF). Those of skill in the art of integrated circuit design can develop such data structures from schematics of the type detailed above and the corresponding descriptions and encode the data structures on the computer-readable medium. Those of skill in the art of integrated circuit fabrication can use such encoded data to fabricate integrated circuits that include one or more of the circuits described herein.

While the preceding discussion used a Wi-Fi communication protocol as an illustrative example, in other embodiments a wide variety of communication protocols and, more generally, wireless communication techniques may be used. Thus, the communication technique may be used in a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the communication technique may be implemented using program module 622, operating system 624 (such as a driver for interface circuit 618) or in firmware in interface circuit 618. Alternatively or additionally, at least some of the operations in the communication technique may be implemented in a physical layer, such as hardware in interface circuit 618.

In the preceding description, we refer to 'some embodiments.' Note that 'some embodiments' describes a subset of all of the possible embodiments, but does not always specify the same subset of embodiments.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. An antenna configured for use with an electronic device mounted on a ceiling, comprising:

a ground plane;

a planar reflector; and antenna elements configured to couple to an interface circuit in the electronic device and which are located between and vertically offset from the ground plane and the planar reflector along a vertical direction, wherein the antenna elements, the ground plane and the planar reflector are configured so that superposition of a reflection from the ground plane, a reflection from the planar reflector, and diffractions from edges of the ground plane and the planar reflector combine to generate an antenna radiation pattern, and wherein the antenna radiation pattern has a horizontal polarization and a direction of a main beam in the antenna radiation pattern of the antenna is tilted towards but offset from a horizontal direction, and wherein a distance between the antenna elements and the ground plane is different from a distance between the antenna elements and the planar reflector.

2. The antenna of claim 1, wherein the direction of the main beam is less than 40° from the horizontal direction.

3. The antenna of claim 1, wherein the ground plane includes a first printed circuit board and the planar reflector includes a second printed circuit board.

4. The antenna of claim 1, wherein the planar reflector floats with respect to the ground plane.

5. The antenna of claim 1, wherein the antenna further comprises a dielectric post between the antenna elements and the planar reflector.

6. The antenna of claim 1, wherein the antenna further comprises a radome, and the planar reflector is included in or coupled to the radome.

7. The antenna of claim 1, wherein the antenna includes one of a switch and a phase-shifter that selectively electrically couples the planar reflector to the ground plane.

8. The antenna of claim 1, wherein the planar reflector includes a metal.

9. A wireless communication device, comprising:

a housing configured to mount on a ceiling;

an interface circuit; and an antenna, wherein the antenna includes:

a ground plane;

a planar reflector; and antenna elements configured to couple to the interface circuit and which are located between and vertically offset from the ground plane and the planar reflector along a vertical direction, wherein the antenna elements, the ground plane and the planar reflector are configured so that superposition of a reflection from the ground plane, a reflection from the planar reflector, and diffractions from edges of the ground plane and the planar reflector combine to generate an antenna radiation pattern, and wherein the antenna radiation pattern has a horizontal polarization and a direction of a main beam in the antenna radiation pattern of the antenna is tilted towards but offset from a horizontal direction, and wherein a distance between the antenna elements and the ground plane is different from a distance between the antenna elements and the planar reflector.

10. The wireless communication device of claim 9, wherein the direction of the main beam is less than 40° from the horizontal direction.

11. The wireless communication device of claim 9, wherein the ground plane includes a first printed circuit board and the planar reflector includes a second printed circuit board.

12. The wireless communication device of claim 9, wherein the planar reflector floats with respect to the ground plane.

13. The wireless communication device of claim 9, wherein the antenna further comprises a dielectric post between the antenna elements and the planar reflector.

14. The wireless communication device of claim 9, wherein the antenna further comprises a radome, and the planar reflector is included in or coupled to the radome.

15. The wireless communication device of claim 9, wherein the antenna includes one of a switch and a phase-shifter that selectively electrically couples the planar reflector to the ground plane.

16. The wireless communication device of claim 9, wherein the planar reflector includes a metal.

17. A method for generating an antenna radiation pattern using an antenna, comprising:

driving, using an interface circuit in an electronic device mounted on a ceiling, antenna elements in the antenna to produce an output beam, wherein the antenna elements are between and vertically offset from a ground plane in the antenna and a planar reflector in the antenna along a vertical direction; and generating an antenna radiation pattern having a main beam by superimposing a reflection of the output beam from the ground plane, a reflection of the output beam from the planar reflector, and diffractions from edges of the ground plane and the planar reflector to generate the antenna radiation pattern, and wherein the antenna radiation pattern has a horizontal polarization and a direction of a main beam in the antenna radiation pattern is tilted towards but offset from a horizontal direction, and wherein a distance between the antenna elements and the ground plane is different from a distance between the antenna elements and the planar reflector.

18. The method of claim 17, wherein the direction of the main beam is less than 40° from the horizontal direction.

19. The method of claim 17, wherein the method comprises selectively electrically coupling the planar reflector to the ground plane.

20. The method of claim 17, wherein the ground plane comprises a first printed circuit board and the planar reflector comprises a second printed circuit board.

* * * * *